United States Patent [19]

Fujita et al.

[11] Patent Number: 5,070,004

[45] Date of Patent: Dec. 3, 1991

[54] BLEACHING STARTER AND PROCESSING OF COLOR PHOTOGRAPHIC SILVER HALIDE PHOTOSENSITIVE MATERIAL USING THE SAME

[75] Inventors: Yoshihiro Fujita, Minami-ashigara; Shigeru Nakamura, Hatano, both of Japan

[73] Assignee: Fuji Photo Film Co., Ltd., Kanagawa, Japan

[21] Appl. No.: 630,639

[22] Filed: Dec. 20, 1990

Related U.S. Application Data

[62] Division of Ser. No. 560,944, Jul. 31, 1990.

[30] Foreign Application Priority Data

Jul. 31, 1989 [JP] Japan ..... 1-198764
Nov. 17, 1989 [JP] Japan ..... 1-298836

[51] Int. Cl.[5] ..... G03C 7/42

[52] U.S. Cl. ..... 430/393; 430/400; 430/430; 430/460; 430/461

[58] Field of Search ..... 430/393, 400, 430, 460, 430/461

[56] References Cited

U.S. PATENT DOCUMENTS

| | | | |
|---|---|---|---|
| 3,578,453 | 5/1971 | Amano et al. | 430/393 |
| 4,923,785 | 5/1990 | Frank | 430/430 |
| 4,927,746 | 5/1990 | Schwartz | 430/393 |
| 4,975,356 | 12/1990 | Cullinan et al. | 430/393 |

*Primary Examiner*—Hoa Van Le
*Attorney, Agent, or Firm*—Sughrue, Mion, Zinn, Macpeak & Seas

[57] ABSTRACT

A bleaching starter which contains an imidazole or a primary or secondary amine having a hydroxyalkyl radical as an alkaline agent exhibits an improved desilvering function without odor and safety problems.

13 Claims, No Drawings

BLEACHING STARTER AND PROCESSING OF COLOR PHOTOGRAPHIC SILVER HALIDE PHOTOSENSITIVE MATERIAL USING THE SAME

This is a divisional of Application No. 07/560,994 filed Jul 31, 1990, now pending.

This invention relates to a bleaching starter and a method for processing a photographic silver halide color photosensitive material using the same.

BACKGROUND OF THE INVENTION

In general, color photographic silver halide photosensitive material, after exposure, is processed through steps of color development, desilvering, washing, and stabilization. Color developers are used for color development, bleaching, bleach-fixing, and fixing solutions used for desilvering, city water or ion exchanged water used for washing, and stabilizers used for stabilization. Typically color photosensitive material is processed by dipping in the respective solutions which are usually adjusted to 30 to 40° C. The color development and desilvering steps are essential among these steps.

In the color development step, the exposed silver halide is reduced with a color developing agent to generate silver whereupon the oxidized color developing agent reacts with a color former or coupler to provide a dye image. In the subsequent desilvering step, the silver generated in the color development step is oxidized by the bleaching agent serving as an oxidizing agent and dissolved away by the fixing agent serving as a complex ion forming agent for silver ion. As a result, only the dye image is formed.

The desilvering step includes a procedure of conducting bleaching and fixing in a common bath, a procedure of conducting bleaching and fixing in separate baths, or a procedure of conducting bleaching and bleach-fixing in separate baths. Each of the baths can have multiple tanks.

In addition to the above-mentioned basic steps, various supplemental steps are taken for the purposes of maintaining photographic and physical properties of dye images and improving storage quality. Such supplemental steps are done in hardening, stop, stabilizing, wash and other baths.

The foregoing steps are generally carried out in automatic processors. In general, automatic processors perform continuous processing in either a "replenishment" or"'batch" mode. The replenishment mode is to make up replenishers in amounts proportional to the quantity of color photosensitive material processed in order to keep the performance of processing solutions constant. The batch mode is to replace all or part of used processing solutions with fresh solutions whenever the quantity of color photo sensitive material processed reaches a predetermined level. Among the two modes, the replenishment mode is often employed for ease of operation.

At the very start of a continuous process or at the restart of a continuous process after replacement of exhausted solutions by fresh solutions, an automatic processor adapted for the replenishment mode is sometimes operated with its processing tanks filled with replenishers as such. However, most replenishers as such are insufficient to provide desirable photographic performance. Therefore, solutions having a somewhat different composition from the replenishers are separately prepared and used as processing solutions (known as mother solutions) at the start.

The processing solutions used at the start include two types, that is, a special kit of reagents and a replenisher having added thereto a modifying agent known as "starter" and optionally water. Particularly in small photographic service laboratories called "mini labo", a system using the "starter" is often employed.

Typically, a bleaching solution used in the desilvering step is also based on the starter system, that is, prepared by combining a starter with a bleaching replenisher. The bleaching starter contains a compound (alkaline agent) which becomes basic or alkaline when dissolved in water. In general, the bleaching solution is designed such as to provide a desired pH level for photographic performance from the start as an alkaline color development solution a color photosensitive material carries in from the preceding bath intermixes with a low pH bleaching replenisher. The alkaline agents used in the prior art are ammonia, potassium hydroxide, and sodium hydroxide.

These prior art alkaline agents, however, have problems associated with handling and photographic performance. For example, ammonia water gives off a foul smell and readily vaporizes so that the effective concentration of ammonia lowers. Potassium hydroxide and sodium hydroxide are not only dangerous to the skin upon contact because they are strong alkalis, but tend to absorb carbon dioxide in air so Q that their effective concentration lowers as in the case of ammonia. They often cause iron hydroxide to precipitate when combined with ferric aminopolycarboxylic acid complexes widely used as the bleaching agent.

In addition to these problems or as a result of these problems, the foregoing alkaline agents, especially potassium hydroxide and sodium hydroxide cause a lowering of bleaching rate, detracting from desilvering ability. Such a loss of desilvering ability becomes outstanding particularly when quick processing is to be done, often disturbing quick processing.

SUMMARY OF THE INVENTION

Therefore, an object of the present invention is to provide a bleaching starter for use in processing with a solution having bleaching ability without handling problems regarding smell and safety. Another object is to provide a method for processing a color photographic silver halide photosensitive material using the bleaching starter which permits quick processing while maintaining sufficient desilvering ability.

According to the present invention, there is provided a starter comprising at least one member selected from compounds of general formulae (I) and (II):

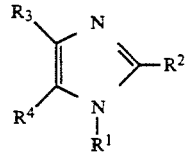

(I)

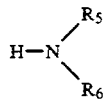

(II)

wherein $R_1$, $R_2$, $R_3$, and $R_4$ are independently selected from the group consisting of a hydrogen atom, an alkyl radical, and an alkenyl radical, $R_5$ is a hydroxyalkyl radical having up to 6 carbon atoms, and $R_6$ is selected from the group consisting of a hydrogen atom, an alkyl radical having up to 6 carbon atoms, and a hydroxyalkyl radical having up to 6 carbon atoms.

Preferably, the bleaching starter contains a compound of formula (I) or (II) in water in an amount of from 0.5 mol/liter to its solubility limit and is at pH 6 to 13.

The present invention also provides a method for processing a color photographic silver halide photosensitive material after imagewise exposure, comprising the steps of: color development and processing with a solution having a bleaching function, wherein the solution having a bleaching function is prepared by adding the above-defined bleaching starter to a solution containing a bleaching agent.

The present invention further provides a method for preparing a processing solution having a bleaching function for a color photographic silver halide photosensitive material, comprising the step of adding the above-defined bleaching starter to a replenisher containing a bleaching agent. The replenisher may be either a bleaching replenisher or a blix replenisher.

According to the present invention, a bleaching starter is combined with a solution having a bleaching functionat the start of processing of a color photographic silver halide photosensitive material. The use of the bleaching starter which contains a compound of general formula (I) or (II) as an alkaline agent permits quick processing while maintaining desilvering ability. The bleaching starter is free of handling problems with respect to smell and safety.

Better results are obtained when the invention is applied to a bleaching step taken immediately after a color development step. In the bleaching step taken immediately after a color development step, the concentration of the color development solution carried into the bleaching solution becomes increased during continuous processing. Thus the alkali concentration in the bleaching starter should be high enough so that the pH at the start of operation is set approximately equal to the pH during continuous processing.

DETAILED DESCRIPTION OF THE INVENTION

A method for processing a color photographic silver halide photosensitive material (often referred to as photo-sensitive material, hereinafter) after imagewise exposure according to the present invention includes the steps of color development and processing with a solution having a bleaching function.

The solutions having a bleaching function are typically a bleaching solution and a bleach-fixing solution. Typical desilvering procedures including processing with such solutions are shown below.

(1) bleaching→fixation
(2) bleaching→bleach-fixation
(3) bleaching→washing→fixation
(4) rinsing→bleaching→fixation
(5) bleaching→bleach-fixation→fixation
(6) washing→bleach-fixation
(7) bleach-fixation
(8) fixation→bleach-fixation Among these procedures, procedures (1), (2), (3) and (5) are preferable. Procedure (2) is described in detail in Japanese Patent Application Unexamined Publication (JP-A) No. 75352/1986.

The processing baths such as bleaching and fixing baths used in the steps of the above-mentioned procedures may have any desired tank configuration including a single tank configuration and a multiple tank configuration (for example, two to four tank configurations with processing solution passed in a counterflow manner).

The present invention is advantageous particularly when it is applied to a procedure wherein a color development step is immediately followed by a desilvering step with a processing solution having a bleaching function. The processing solution having a bleaching function used herein is preferably a bleaching solution. The best sequence to which the invention is applicable is, therefore, a color development step immediately followed by a bleaching step. Such a bleaching step is described below as a typical embodiment.

Bleaching

The bleaching step is carried out using a bleaching starter.

In an automatic processor adapted for continuous processing, the bleaching starter is used to prepare a starting bleaching solution (that is, mother solution) to be filled in the processing tank at the very start of operation or at the restart of operation after the exhausted processing solution is replaced by a fresh solution. More particularly, the starting bleaching solution is prepared by adding the bleaching starter to a bleaching replenisher and optionally adding water. In this sense, the bleaching starter is a processing agent for correction.

Since the bleaching replenisher has been adjusted to a lower pH than the desired pH of the bleaching solution, the bleaching starter is used for the main purpose of adjusting the starting bleaching solution to a proper pH. For this purpose, the bleaching starter contains an alkaline agent.

The bleaching starter of the invention is an aqueous solution containing a compound of general formula (I) or (II) as the alkaline agent.

Formula (I):

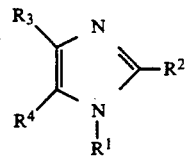

(I)

In formula (I), $R_1$, $R_2$, $R_3$, and $R_4$ are independently selected from the group consisting of a hydrogen atom, an alkyl radical, and an alkenyl radical. The alkyl radicals may be either substituted or unsubstituted ones, with unsubstituted ones being preferred, and preferably have 1 to 5 carbon atoms, more preferably 1 to 2 carbon atoms. Unsubstituted alkyl radicals such as methyl and ethyl are preferred. The alkenyl radicals may be either substituted or unsubstituted ones and preferably have 2 to 5 carbon atoms, more preferably 2 to 3 carbon atoms. Unsubstituted alkenyl radicals such as vinyl and allyl are preferred. For substituted alkyl and alkenyl radicals, the preferred substituents are hydroxyl, amino and nitro radicals.

Preferably, $R_1$ through $R_4$ are selected from a hydrogen atom and an unsubstituted alkyl radical having 1 or 2 carbon atoms. More preferably, only one of $R_1$ through $R_4$ is an alkyl radical. Most preferably, all $R_1$ through $R_4$ are hydrogen atoms.

Several, non-limiting examples of the compound of formula (I) are given below.

I-1:imidazole
I-2:1-methylimidazole
I-3:2-methylimidazole
I-4:4-methylimidazole
I-5:4-hydroxymethylimidazole
I-6:1-ethylimidazole
I-7:1-vinylimidazole
I-8:4-aminomethylimidazole
I-9:2,4-dimethylimidazole
I-10:2,4,5-trimethylimidazole
I-11:2-aminoethylimidazole
I-12:2-nitroethylimidazole Among them, compounds I-1, I-2, I-3, I-4, and I-6 are preferred, with I-1 being most preferred. These imidazole compounds generally have an acid dissociation constant (pKa) of 6 to 10, especially 6.5 to 8.5. The imidazole compounds of formula (I) are commercially available and applicable as such to the present invention.

Formula (II):

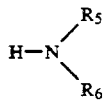

In formula (II), $R_5$ is a hydroxyalkyl radical having 1 to 6 carbon atoms, and $R_6$ is selected from the group consisting of a hydrogen atom, an alkyl radical having 1 to 6 carbon atoms and a hydroxyalkyl radical having 1 to 6 carbon atoms.

The hydroxyalkyl represented by $R_5$ preferably have 2 to 4 carbon atoms. Examples of the hydroxyalkyl represented by $R_5$ include hydroxymethyl, hydroxyethyl, hydroxypropyl, hydroxybutyl, hydroxypentyl, and hydroxyhexyl, with the hydroxyethyl, hydroxypropyl, and hydroxybutyl being preferred.

The alkyl and hydroxyalkyl radicals represented by $R_6$ preferably have 1 to 3 carbon atoms. For $R_6$, examples of the alkyl include methyl, ethyl, propyl, butyl, pentyl, and hexyl, and examples of the hydroxyalkyl are the same as enumerated for $R_5$. Preferably $R_6$ is hydrogen, methyl, ethyl, propyl, hydroxyethyl or hydroxypropyl.

The total number of carbon atoms included in $R_5$ and $R_6$ is preferably in the range of from 2 to 5 because the compounds of formula (II) become fully soluble in water.

Several, non-limiting examples of the compound of formula (II) are given below.

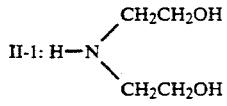

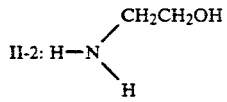

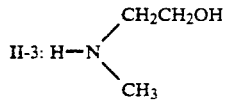

-continued

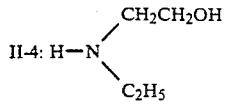

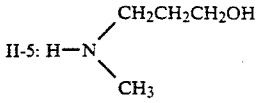

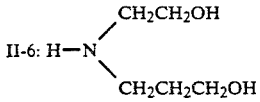

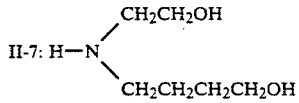

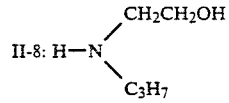

These compounds have an acid dissociation constant (pKa) of 6 to 12, especially 7 to 10. The compounds of formula (II) are commercially available and applicable as such to the present invention. If it is desired to synthesize the compounds, any well-known methods may be used.

The compounds of formulae (I) and (II) are preferably contained in the bleaching starter in concentrations of from 0.5 mol/liter to the solubility limit, more preferably from 1 mol/liter to the solubility limit, most preferably from 3 to 10 mol/liter. The bleaching starter preferably has pH 6 to 13, more preferably pH 6 to 12, most preferably pH 8 to 11. Excessively high pH levels are undesirable due to promoted absorption of carbon dioxide.

The present compounds allow the bleaching starter to Q assume a pH level which cannot be achieved with the prior art commonly used potassium hydroxide, sodium hydroxide and aqueous ammonia while minimizing a loss of effective ingredients by carbon dioxide.

The bleaching starter is added to a bleaching replenisher to prepare a starting bleaching solution as previously described. The bleaching replenisher is generally adjusted to pH 0.2 to 6, preferably pH 2 to 4, while the starting bleaching solution is adjusted to pH 0.4 to 9.0, preferably pH 2.5 to 6.5. The volume ratio of bleaching replenisher to bleaching starter generally ranges from 1/2 to 200/1, preferably from 1/2 to 100/1, more preferably from 5/1 to 20/1.

The compounds of formulae (I) and (II) may be used alone or in admixture of any two or more. When a mixture of such compounds is used, the total amount should comply with the above-mentioned concentration.

As previously described, potassium hydroxide, sodium hydroxide and aqueous ammonia are used as the alkaline agent in the prior art bleaching starters. These conventional alkaline agents are unsatisfactory in handling and desilvering function. These problems becomes more outstanding in the replenishment mode of operation when the replenishing quantity is small or the bleaching replenisher has low pH as in the present invention because the alkaline agent must be added to the bleaching starter in increased concentrations. For example, aqueous ammonia gives off a foul smell and readily vaporizes so that the concentration changes. Potassium hydroxide and sodium hydroxide also change their concentration by absorbing carbon dioxide in air, often cause a precipitate of iron hydroxide when ferric aminopolycarboxylic acid complexes are used as the bleaching agent, and their strong alkalinity imposes a safety problem. Probably because of concentration changes, potassium hydroxide and sodium hydroxide suffer from problems of slow bleaching and reduced desilvering ability.

These problems can be overcome by using the compounds of formulae (I) and (II). That is, the bleaching starters based on the compounds of formulae (I) and (II) not only have eliminated the handling problem even in highly concentrated form, but can promote bleaching action to provide an improved desilvering ability. Such advantages are obtained only with the use of the compounds of formulae (I) and (II), but not with other compounds.

For example, British Patent No. 1,138,842 discloses 2 mercaptoimidazole compounds having an imidazole nucleus analogous to the compounds of general formula (I). However, these mercaptoimidazoles cannot be alkaline agents for adjusting the pH of a bleaching solution, failing to achieve the advantages as in the present invention.

Although it is essential and satisfactory for the present invention that the bleaching starter contains only a compound of formula (I) or (II), the bleaching starter may further contain a minor amount of an acid (e.g., hydrochloric acid, sulfuric acid, acetic acid, and nitric acid) and another alkaline agent (e.g., potassium hydroxide, sodium hydroxide, and aqueous ammonia) for pH fine adjustment insofar as the benefits of the invention are achievable. The concentration of such an acid or additional alkaline agent should be less than one half, preferably less than 1/10 of the total concentration of the compounds of formulae (I) and (II).

The bleaching replenisher to be combined with the bleaching starter according to the invention and the starting bleaching solution prepared therefrom contain a bleaching agent. The bleaching agents used herein include compounds of polyvalent metals such as iron (III), cobalt (III), chromium (VI), and copper (II), peracids, quinones, and nitro compounds. Typical bleaching agents are iron (III) salts, such as ferric chloride; ferricyanides; bichromates; organic complexes of iron (III) and cobalt (III), for example, complexes with aminopolycarboxylic acids such as ethylenediaminetetraacetic acid, diethylenetriamine pentaacetic acid, cyclohexanediaminetetraacetic acid, methyliminodiacetic acid, 1,3 diaminopropanetetraacetic acid, and glycol ether diamine tetraacetic acid, and carboxylic acids such as citric acid, tartaric acid, and malic acid; persulfates; bromates; permanganates; and nitrobenzenes. Among these the ferric aminopolycarboxylic acid complexes are preferred for environmental protection, safe handling, and metal corrosion.

Examples of the ferric aminopolycarboxylic acid complex are shown below together with their redox potential although other examples will occur to those skilled in the art.

| Compound No. | Redox potential (mV vs. NHE, pH = 6) |
|---|---|
| 1. Ferric N-(2-acetamide)iminodiacetic acid complex | 180 |
| 2. Ferric methyliminodiacetic acid complex | 200 |
| 3. Ferric iminodiacetic acid complex | 210 |
| 4. Ferric 1,4-butylenediaminetetraacetic acid complex | 230 |
| 5. Ferric diethylenethioetherdiamine-tetraacetic acid complex | 230 |
| 6. Ferric glycoletherdiaminetetraacetic acid complex | 240 |
| 7. Ferric 1,3-propylenediaminetetraacetic acid complex | 250 |
| 8. Ferric ethylenediaminetetraacetic acid complex | 110 |
| 9. Ferric diethylenetriaminepentaacetic acid complex | 80 |
| 10. Ferric trans-1,2-cyclohexanediamine-tetraacetic acid complex | 80 |

The redox potential of the foregoing bleaching agents is measured by the method described in Transactions of the L Faraday Society, Vol. 55, 1312.1313 (1959).

In the practice of the invention, those bleaching agents having a redox potential of at least 150 mV, preferably at least 180 mV, more preferably at least 200 mV are selected for quicker bleaching. Most preferred is compound No. 7, ferric 1,3-propylenediaminetetraacetic acid complex (to be abbreviated as 1,3-PDTA-Fe(III)).

The ferric aminopolycarboxylate complexes are used in the form of salts with sodium, potassium, ammonium and the like although ammonium salts are preferred for fastest bleaching.

In the practice of the invention, the bleaching agents may be used alone or in admixture of two or more. In case when a bleaching agent having a redox potential of lower than 150 mV is used in addition to a bleaching agent having a redox potential of at least 150 mV, preferably up to 0.5 mol of the former bleaching agent is present per mol of the latter bleaching agent. A bleaching agent to be combined with a ferric aminopolycarboxylic acid complex having a redox potential of at least 150 mV is preferably selected from ferric ethylenediaminetetraacetic acid, diethylene triaminepentaacetic acid, and cyclohexanediaminetetraacetic acid complexes.

The bleaching solution preferably contains at least 0.10 mol/liter of the bleaching agent, preferably at least 0.20 mol/liter of the bleaching agent for quicker bleaching and minimized bleaching fog and stains. More preferably, at least 0.25 mol of the bleaching agent is present per liter of the bleaching solution. The upper limit is generally about 0.7 mol/liter because bleaching solutions having excessively high concentrations of the bleaching agent rather restrain bleaching reaction. When two or more bleaching agents are used, the total amount should comply with the above defined concentration.

The bleaching replenisher preferably contains at least 0.1 mol/liter, preferably at least 0.2 mol/liter, more preferably at least 0.3 mol/liter of the bleaching agent. The upper limit is the solubility limit.

In the practice of the invention, a bleaching solution containing at least 0.2 mol/liter of a bleaching agent having a redox potential of at least 150 mV ensures rapid bleaching. The invention becomes more effective when applied to such processing.

Where a ferric aminopolycarboxylic acid complex is used in a bleaching replenisher or bleaching solution, it may be added in a complex salt form as previously described. Alternatively, it is possible that a complex-forming compound or aminopolycarboxylic acid and a ferric salt (e.g., ferric sulfate, ferric chloride, ferric nitrate, ammonium ferric sulfate, ferric phosphate, and ferric acetate) be copresent in a bleaching solution such that a complex salt is formed in situ. In the case of in situ complex formation, an aminopolycarboxylic acid may be added somewhat in excess of the amount necessary to form a complex with a ferric ion, preferably in a 0.01 to 10% excess amount.

The bleaching solution is generally used at pH 0.4 to 9. For quicker processing, the bleaching solution is adjusted to pH 2.5 to 6.5, preferably pH 2.5 to 4.0, more preferably pH 2.5 to 3.5.

The bleaching replenisher is generally at pH 0.2 to 6.0 and adjustable to the above-mentioned pH range by adding the bleaching starter.

The bleaching replenisher mainly used for the preparation of bleaching solution may be adjusted to the above-mentioned pH range using a well-known acid. The acids used herein preferably have pKa of 2 to 5. The pKa is an acid dissociation constant as measured at an ionic strength of 0.1 mol/liter and 25° C. In the practice of the invention, a bleaching solution containing at least 1.2 mol/liter of an acid with pKa 2.0 to 5.0 is preferably used in a desilvering step because bleaching fog is further reduced and stain increase in undeveloped areas after processing is improved.

The acids with pKa 2.0 to 5.0 includes inorganic acids such as phosphoric acid and organic acids such as acetic acid, malonic acid, and citric acid although the organic acids are preferred. Organic acids having a carboxyl group are especially preferred.

The acids with pKa 2.0 to 5.0 may be either monobasic or polybasic acids. Polybasic acids may be used in the form of metal salts (e.g., sodium and potassium salts) or ammonium salts which have pKa 2.0 to 5.0. It is also possible to use a mixture of two or more organic acids with pKa 2.0 to 5.0. Aminopolycarboxylic acids and their Fe complexes are excluded herein.

Preferred examples of the organic acid with pKa 2.0 to 5.0 used herein include aliphatic monobasic acids such as formic acid, acetic acid, monochloroacetic acid, monobromo acetic acid, glycolic acid, propionic acid, monochloro propionic acid, lactic acid, pyruvic acid, acrylic acid, butyric acid, isobutyric acid, pivalic acid, aminobutyric acid, valeric acid, and isovaleric acid; amino acids such as asparagine, alanine, alginine, ethionine, glycine, glutamine, cysteine, serine, methionine, and leucine; aromatic monobasic acids such as benzoic acid, mono substituted benzoic acids (e.g., chlorobenzoic acid and hydroxybenzoic acid), and nicotinic acid; aliphatic dibasic acids such as oxalic acid, malonic acid, succinic acid, tartaric acid, malic acid, maleic acid, fumaric acid, oxalacetic acid, glutaric acid, and adipic acid; dibasic amino acids such as aspartic acid, glutamic acid, glutaric acid, cystine, and ascorbic acid; aromatic dibasic acids such as phthalic acid and terephthalic acid; and polybasic acids such as citric acid. Among these, preferred are monobasic acids having a carboxyl group, especially acetic acid and glycolic acid.

The total amount of the acid or acids used is generally at least 0.5 mol, preferably at least 1.2 mol per liter of the bleaching solution. More preferably, the bleaching solution contains 1.2 to 2.5 mol/liter, especially 1.5 to 2.0 mol/liter of the acid(s).

The bleaching replenisher mainly used to prepare a bleaching solution can be adjusted to the above-mentioned pH range by adding the above-mentioned acid and the alkaline agent (e.g., aqueous ammonia, KOH, and NaOH) insofar as the benefits of the invention are obtained. Use of aqueous ammonia is desirable.

In the practice of the invention, the bleaching solution (that is, bleaching replenisher) or a preceding bath may contain any of bleaching accelerators. These bleaching accelerators include mercapto or disulfide group-containing compounds as disclosed in U.S. Pat. No. 3,893,858, West German Patent No. 1,290,812, British Patent No. 1,138,842, JP-A 95630/1978, and Research Disclosure, No. 17129 (July 1978); thiazoline derivatives as disclosed in JP-A 140129/1975; thiourea derivatives as disclosed in U.S. Pat. No. 3,706,561; iodides as disclosed in JP-A 16235/1983; polyethylene oxides as disclosed in West German Patent No. 2,748,430; and polyamine compounds as disclosed in JP-B 8836/1970. The mercapto compounds disclosed in British Patent No. 1,138,842 are preferred.

In addition to the above-mentioned bleaching and other agents, the bleaching solution according to the invention may further contain a re-halogenating agent, for example, bromides such as potassium bromide, sodium bromide, and ammonium bromide and chlorides such as potassium chloride, sodium chloride, and ammonium chloride. The concentration of the re-halogenating agent is generally 0.1 to 5 mol, preferably 0.5 to 3 mol per liter of the bleaching solution. Also included is an anti-metal corrosion agent such as ammonium nitrate.

When the invention is practiced in the replenishment mode, the bleaching solution is made up with less than 200 ml, preferably 140 to 10 ml of replenisher per square meter of photosensitive material being processed.

The bleaching time is generally up to 120 seconds, preferably up to 60 seconds, more preferably up to 50 seconds. The invention is effective with such a brief bleaching time.

During processing, the bleaching solution containing a ferric aminopolycarboxylic acid complex is preferably aerated so as to oxidize the resulting ferrous aminopolycarboxylic acid complex.

Fixation or bleach-fixation

In the preferred desilvering process, the photo-sensitive material, after bleached with the bleaching solution as mentioned above, is typically processed in a agent.

The fixing agents used herein include thiosulfates such as sodium thiosulfate, ammonium thiosulfate, sodium ammonium thiosulfate and potassium thiosulfate; thiocyanates or rhodanates such as sodium thiocyanate, ammonium thiocyanate, and potassium thiocyanate; thioureas; thioethers, and the like. The preferred fixing agent is ammonium thiosulfate. The fixing agent is generally used in an amount of 0.3 to 3 mol, preferably 0.5 to 2 mol per liter of the fixing or bleach-fixing solution.

For accelerating fixation, ammonium thiocyanate (or ammonium rhodanate), thiourea, or a thioether (e.g., 3,6-dithia-1,8-ocatanediol) may be used in combination with ammonium thiosulfate. The additional fixing agent is generally used in an amount of 0.01 to 0.1 mol per liter of the fixing or bleach-fixing solution although 1 to 3 mol/liter of the additional fixing agent may be used to substantially accelerate fixation, if desired.

As to the fixing agent in the fixing or bleach-fixing solution, a combination of a thiosulfate and a thiocyanate, especially ammonium thiosulfate and ammonium thiocyanate is preferred for quicker processing. In this case, 0.3 to 3 mol/liter of the thiosulfate and 1 to 3 mol/liter, especially 1 to 2.5 mol/liter of the thiocyanate may be used.

Examples of the compounds (other than the thiocyanates) which can be used in combination with the thiosulfates, especially, ammonium thiosulfate include thioureas and thioethers such as 3,6.dithia.1,8.octanediol. The additional compound is generally used in an amount of about 0.01 to 0.1 mol per liter of the fixing or bleach-fixing solution although 1 to 3 mol/liter of the additional compound may be used, if desired.

The fixing or bleach-fixing solution contains as a preservative sulfites (e.g., sodium sulfite, potassium sulfite, and ammonium sulfite), and bisulfite adducts of hydroxylamine, hydrazine and aldehyde compounds (e.g., acetaldehyde sodium bisulfite). Preferred preservatives are sulfinic acid derivatives described in Japanese Patent Application No. 283881/1985. Also included are various brighteners, defoaming agents or surface active agents, polyvinyl pyrrolidone, and organic solvents such as methanol.

The bleach-fixing solution may contain any well known bleaching agents as previously mentioned. Preferred are ferric aminopolycarboxylate complexes. The bleach fixing solution generally contains 0.01 to 0.5 mol, preferably 0.015 to 0.3 mol, more preferably 0.02 to 0.2 mol of the bleaching agent per liter of the solution.

The bleach-fixing solution (mother solution) used at the start of processing is prepared by dissolving the necessary ingredients as mentioned above in water or by mixing amounts of a bleaching solution and a fixing solution which have been separately prepared. The fixing solution is preferably at pH 5 to 9, more preferably pH 7 to 8. The bleach-fixing solution is preferably at pH 6 to 8.5, more preferably pH 6.5 to 8.0.

When the invention is practiced in the replenishment mode, the fixing or bleach-fixing solution is made up with 50 to 3,000 ml, preferably 100 to 1,000 ml of replenisher per square meter of photosensitive material being processed.

The fixing or bleach-fixing solution may further contain various aminopolycarboxylic acids and organic phosphonic acids for stabilizing purposes.

The fixing or bleach-fixing step following the bleaching step in the preferred desilvering process of the invention continues ½ to 2 minutes, preferably 1 to 1-½ minutes in total. The invention is effective with such a brief fixing or bleach-fixing time.

The benefits of the invention becomes more prominent as the total processing time of the desilvering process becomes shorter. Preferably, the total processing time is 1 to 4 minutes more preferably 1½ to 3 minutes. The processing temperature is generally 25 to 50° C., preferably 35 to 40°C. At processing temperatures of from 35 to 45° C., desilvering rate is increased and stain occurrence after processing is suppressed.

Although the procedure in which a color development step is immediately followed by a bleaching step has been described as the preferred desilvering process according to the present invention, the bleaching starter of the invention is also applicable to a procedure in which a color development step is immediately followed by a bleach-fixing step (for example, desilvering procedure (7) mentioned above). As in the case of the bleaching solution, a starting bleach-fixing solution (mother solution) is prepared by adding a bleach-fixing starter to a bleach-fixing replenisher.

The bleach-fixing starter has essentially the same composition as the bleaching starter mentioned above. The concentration of the alkaline agent, that is, compound of formula (I) or (II) and pH are the same as previously mentioned.

The bleach-fixing starter is added to a bleach-fixing replenisher to prepare a starting bleach-fixing solution. The bleach-fixing replenisher is generally adjusted to pH 2 to 6.5, preferably pH 3 to 6, while the starting bleach fixing solution is adjusted to pH 3 to 7, preferably pH 4 to 6.5. The volume ratio of bleach fixing replenisher to bleach-fixing starter generally ranges from ½ to 100/1, preferably from 5/1 to 50/1.

The bleach-fixing replenisher has essentially the same composition as the bleach-fixing solution except that the ingredients are generally increased 4 to 100% as compared with the bleach.fixing solution.

The use of the bleach-fixing starter is applicable not only to the bleach-fixing solution in the bleach fixing step following the bleaching step, but also to other bleach-fixing solutions in general bleach-fixing steps. The bleach-fixing starter may be used in the same fashion as the bleaching starter.

Furthermore, the bleaching starter is applicable not only to the bleaching step in the preferred desilvering procedure, but also to general bleaching steps. In this sense, the bleach-fixing starter need not be distinguished from the bleaching starter. Therefore, the bleaching starter is used herein as encompassing both a bleaching starter and a bleach-fixing starter. In the desilvering procedure, agitation is done as intensely as possible because more benefits of the invention are obtained. Agitation can be promoted by various techniques, for example, injection of a jet flow of processing solution against the emulsion surface of photosensitive material as disclosed in JP-A 183460/1987 and 183461/1987, and rotary means for promoting agitation as disclosed in JP-A 183461/1987. Alternatively, agitation can be promoted by placing a wiper blade in a processing solution and moving photosensitive material through the solution with its emulsion surface in contact with the wiper blade, thereby inducing turbulent solution flow on the emulsion surface. It is also possible to increase the rate of circulation flow over the entire processing solution. Such agitation promoting means are effective to any of bleaching, bleach-fixing, and fixing solutions. Promoted agitation ensures that more bleaching or fixing agent be available to the emulsion film, resulting in an increased desilvering rate.

The agitation promoting means becomes more effective when a bleaching promoter is used because bleaching promotion is further enhanced and fixation restraint by the bleaching promoter is eliminated.

The present invention is generally implemented by a continuous process using an automatic processor. The automatic processor used herein is preferably equipped with means for conveying photosensitive material as disclosed in JP-A 191257/1985, 191258/1985, and 191259/1985. As described in JP-A 191257/1985, such conveyor means can substantially reduce the carry-out of processing solution from a bath to a subsequent bath, minimizing a loss of performance of the subsequent bath. This is effective in shortening the processing time in respective steps and reducing the amount of processing solution replenished.

The benefits of the invention becomes more prominent as the total processing time of the entire process (excluding drying time) becomes shorter. Preferably, the total processing time is up to 8 minutes. With a total processing time of up to 7 minutes, the difference between the invention and the conventional process becomes substantial.

Color development

The color developer used in the practice of the invention contains any of well-known aromatic primary amine color developing agents. Preferred color developing agents are p-phenylenediamine derivatives, typical, non-limiting examples of which are shown below.

D-1: N,N-diethyl-p-phenylenediamine
D-2:2-amino-5.diethylaminotoluene
D-3 2- amino.5-(N-ethyl-N-laurylamino)toluene
D-4:4-[N-ethyl-N-(β-hydroxyethyl)amino]aniline
D-5:2-methyl-4-[N-ethyl-N-(β-hydroxyethyl)amino]-aniline
D-6:4-amino-3-methyl- N-ethyl-N-[β-(methanesulfonamide) ethyl]aniline
D-7:N-(2-amino-5-diethylaminophenylethyl)methanesulfonamide
D-8:N,N.dimethyl-p-phenylenediamine
D-9:4-amino-3-methyl-N-ethyl-N-methoxyethylaniline
D-10:4-amino-3-methyl-N-ethyl-N-β-ethoxyethylaniline
D-11:4-amino-3-methy-N-ethyl-N-β-butoxyethylaniline Among the foregoing p phenylenediamine derivatives, especially preferred is compound D-5. These p-phenylene-diamine derivatives may take salt forms, for example, sulfate, hydrochlorate, sulfite, and p-toluenesulfonate salts. The aromatic primary amine color developing agents are generally used in amounts of about 0.1 to 20 grams, preferably about 0.5 to 10 grams per liter of the color developer.

The color developer may contain a preservative, for example, sulfites such as sodium sulfite, potassium sulfite, sodium bisulfite, potassium bisulfite, sodium metasulfite, and potassium metasulfite, and carbonyl sulfite adducts if desired. The preservative is preferably added in an amount of 0.5 to 10 grams, more preferably 1 to 5 grams per liter of the color developer.

Also useful are compounds which can directly preserve the aromatic primary amine color developing agents, for example, hyiroxylamines, hydroxamic acids as described in JP-A 43138/1988, hydrazines and hydrazides as described in JP-A 146041/1988, phenols as described in JP-A 44657/1988 and 58443/1988, α-hydroxyketones and α-aminoketones as described in JP-A 44656/1988, and various saccharides as described in JP-A 36244/1988. These compounds may be used in combination with monoamines as described in JP-A 4235/1988, 24254/1988, 21647/1988, 146040/1988, 27841/1988 and 25654/1988, diamines as described in JP-A 30845/1988, 14640/1988, and 43139/1988, polyamines as described in JP-A 21647/1988, 26655/1988, and 44655/1988, nitroxy radicals as described in JP-A 53551/1988, alcohols as described in JP-A 43140/1988 and 53549/1988, oximes as described in JP-A 56654/1988, and tertiary amines as described in JP-A 239447/1988.

Other useful preservatives include various metals as described in JP-A 44148/1982 and 53749/1982, salicylates as described in JP-A 180588/1984, alkanol amines as described in JP-A 3582/1979,polyethylene imines as described in JP-A 94349/1981, and aromatic polyethylene compounds as described in U.S. Pat. No. 3,746,544. Among these, preferred are aromatic polyhydroxy compounds.

The color developer used herein is generally at pH 9 to 12, preferably pH 9 to 11.0. The color developer may further contain any of known developer ingredients.

To maintain the above-defined range, various buffer agents are preferably used. Several non-limiting examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydrozybenzoate, sodium 5-sulfo-2-hydroxybenzoate (sodium 5-sulfosalicylate), and potassium 5-sulfo-2-hydroxybenzoate (potassium 5-sulfosalicylate). The buffer agent is preferably added to the color developer in an amount of at least 0.1 mol/liter, more preferably 0.1 to 0.4 mol/liter.

Various chelating agents may be added to the color developer as an agent for preventing precipitation of calcium and magnesium or for improving the stability of the color developer. Preferred chelating agents are organic acids, for example, aminopolycarboxylic acids, organic phosphonic acids, and phosphonocarboxylic acids. Non-limiting examples of the acids include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycol ether diamine tetraacetic acid, ethylenediamine orthohydroxyphenylacetic acid, 2-phosphonobutane-1,2,4-tricarboxylic acid, 1-hydroxyethylidene-1,1-diphosphonic acid, and N,N'-bis (2-hydroxybenzyl) ethylenediamine-N,N'-diacetic acid. The chelating agents may be used alone or in admixture of two or more. The chelating agent is added to the color developer in a sufficient amount to block metal ions in the developer, for example, 0.1 to 10 grams per liter of the developer.

The color developer may contain a development promoter if desired. However, it is recommended for environmental protection, ease of preparation, and color stain prevention that the color developer is substantially free of benzyl alcohol. The term "substantially free" means that the color developer contains only up to 2 ml of benzyl alcohol or does not contain benzyl alcohol. Useful development promoters include thioethers as described in JP-B 16088/1962, 5987/1962, 7826/1963, 12380/1969, and 9019/1970 and U.S. Pat. No. 3,818,247,p-phenylenediamine compounds as described in JP-A 49829/1977 and 15554/1975, quaternary ammonium salts as described in JP-B 30074/1969, JP-A 137726/1975 156826/1981, 43429/1977, amine compounds as described in U.S. Pat. Nos. 2,482,546, 2,494,903, 2,596,926, 3,128,182, 3,253,919, 3,582,346 and 4,230,796 and JP-B 11431/1966, and polyalkylene oxides as described in JP-B 16088/1962 11431/1966, 23883/1967 and 25201/1967, U.S. Pat. Nos. 3,128,183 and 3,532,501 as well as 1-phenyl-3-pyrazolidones and imidazoles.

The color developer may further contain any antifoggant if desired. Useful antifoggants are alkali metal halides such as sodium chloride, potassium bromide, and potassium iodide and organic antifoggants. Typical examples of the organic antifoggant include nitrogenous heterocyclic compounds, for example, benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developer used herein may further contain a brightener which is typically a 4,4'- diamino-2,2'-disulfostilbene compound. It is typically used in an amount of 0 to 5 gram/liter, preferably 0.1 to 4 gram/liter.

If desired, various surface active agents, for example, alkyl sulfonic acids, aryl sulfonic acids, aliphatic carboxylic acids, and aromatic carboxylic acids may be added.

The temperature at which photosensitive material is processed with the color developer is generally 20 to 50° C., preferably 30 to 40° C. The processing time generally ranges from 20 seconds to 5 minutes, preferably from 30 seconds to 3½ minutes. When the invention is practiced in the replenishment mode, the color developer is made up with as small amounts of replenisher as possible, generally 100 to 1,500 ml, preferably 100 to 800 ml, more preferably 100 to 400 ml of replenisher per square meter of photosensitive material being processed.

the color developing bath may be divided into two or more baths if desired. In this embodiment, the color developer replenisher is preferably supplied to the first or last bath in order to shorten the developing time or reduce the replenishment amount.

The processing method of the invention is also applicable to color reversal processes. The black-and-white developer used in this case is a first black-and-white developer used in a conventional color reversal process of color photosensitive material. Various well-know additives added to black-and-white developers used in the processing of black-and-white silver halide photosensitive material may be added to the first black-and-white developer for color reversal photosensitive material.

Typical additives include a developing agent such as 1-phenyl-3-pyrazolidone, Metol (p-methylaminophenol sulfate) and hydroquinone; a preservative such as sulfites; a promoter, for example, alkalis such as sodium hydrozide, dosium carbonate, and potassium carbonate; an inorganic or organic inhibitor such as potassium bromide, 2-methylbenzimidazole, and methylbenzthiazole; a water softener such as polyphosphates; and a development restrainer such as trace amounts of iodides and mercapto compounds.

The processing method of the invention generally includes color development, bleaching, bleach-fixing, fixing and other steps. The bleach-fixing or fixing step is usually followed by a washing or stabilizing step. A simplified process having a fixing function is directly followed by a stabilizing step without substantial washing may be employed.

Wash water used in the washing step may contain any well-known additives if desired. Useful additives are water softeners such as aminopolycarboxylic acids and organic and inorganic phosphoric acids, biocides for preventing propagation of bacteria and algae, fungicides such as isothiazolone, organic chlorine base fungicides, and benzothriazole, as well as surface active agents for reducing drying loads and preventing drying marks. Other useful additives are described in L. E. West, "water Quality Criteria", Phot. Sci. and Eng., Vol 9, No. 6, 344-359 (1965)

The stabilizer used in the stabilizing step may be a processing solutions at pH 3 to 6 and solutions containing aldehydes such as formalin. The stabilizer may contain ammonoim compounds, metal compounds such as Bi and Al, brighteners, chelating agents (e.g., 1-hydrozyethylidene-1,1-diphosphonic acid), bactericides, fungicides, hardeners, surface active agents, and alkanol amines, if desired.

The washing and stabilizing steps are preferably carried out in a multi-stage counterflow mode, with 2 to 4 stages being preferred. The replenishment amount per unit area is 1 to 50 times, preferably 2 to 30 times, more preferably 2 to 15 times the carry-in from the preceding bath.

Water used in the washing and stabilizing steps may be city water, deionized water having a Ca and Mg concentration reduced to less than 5 mg/liter by passage through ion exchange resins, and water sterilized with halogen or under UV sterilizing lamps.

In the continuous processing through an automatic processor, the processing solutions used in the respective steps of processing color photosensitive material can be concentrated through evaporation. Such concentration through evaporation becomes substantial when the throughput quantity is small or the solution is exposed over a large area. To compensate for such concentration, an appropriate amount of water or correcting solution is preferably supplemented to the processing solution.

The quantity of solution discarded can be reduced by introducing an overflow from the washing or stabilizing step into the preceding bath, that is, bath having a fixing function.

Photosensitive material

The photosensitive material which can be processed by the present method is one having at least one silver halide emulsion layer for each of blue-, green- and red-sensitive layers on a support. The number and sequence of silver halide emulsion layers and non-photosensitive layers are not critical.

Typical are color photographic silver halide photosensitive materials having a plurality of silver halide emulsion layers having substantially equal color sensitivity, but different photographic sensitivity as photosensitive layers. The photosensitive layers are unit photosensitive layers each having color sensitivity to blue, green or red light. In color photographic silver halide photosensitive materials of multi-layer structure, unit photosensitive layers are generally arranged in the order of a red-sensitive layer, a green-sensitive layer, and a blue-sensitive layer from the support side. If desired, the stacking order may be reversed or an arrangement in which same color sensitive layers are separated by a different color sensitive layer may be used.

Various non-photosensitive layers like intermediate layers may be provided between or at the top or bottom of the silver halide photosensitive layers. Such intermediate layers may contain couplers and DIR compounds as disclosed in JP-A 43748/1986, 113438/1984, 113440/1984, 20037/1986 and 20038/1986 as well as commonly used anti-color-mixing agents, UV absorbers, and anti-staining agents.

The silver halide emulsion layers constituting unit photosensitive layers are preferably of the two-layer structure consisting of high and low sensitivity emulsion layers as disclosed in West German Patent No. 1,121,470 or British Patent No. 923,045. In general, layers are arranged such that their sensitivity gradually lowers toward the support. Non-photosensitive layers may be provided between silver halide emulsion layers. It is also possible that low sensitivity emulsion layers be disposed remote from the support and high sensitivity emulsion layers disposed adjacent to the support as disclosed in JP-A 112751/1982, 200350/1987, 206541/1987, and 206543/1987. Illustrative examples are, described from a side remotest from the support, the order of low sensitivity blue-sensitive layer (BL)/high sensitivity blue-sensitive layer (BH)/high sensitivity green-sensitive layer (GH)/low sensitivity green-sensitive layer (GL)/high sensitivity red-sensitive layer (RH)/low sensitivity red-sensitive layer (RL), the order of BH/BL/GL/GH/RH/RL or the order BH/BL/GH/GL/ RL/Rh.

Further, it is possible to arrange photosensitive layers in the order of blue-sensitive layer/GH/RH/GL/RL from the farthest from the support as described in JP-B 34932/1980. It is also possible to arrange photosensitive layers in the order of blue-sensitive layer/GL/RL/GH/RH from the farthest from the support as described in JP-A 25738/1981 and 63936/1987.

JP-B 15495/1974 discloses a still another arrangement of three layers having different sensitivities in which a silver halide emulsion layer having the highest sensitivity is at the top, a silver halide emulsion layer having lower sensitivity is at an intermediate, a silver halide emulsion layer having further lower sensitivity is at the bottom so that sensitivity successively lowers toward the support. Even in the arrangement of three layers having different sensitivities, layers constituting the same color sensitive layer may be disposed in the order of intermediate sensitivity emulsion layer/high sensitivity emulsion layer/low sensitivity emulsion layer as described in JP-A 202464/1984.

The composition and arrangement of layers may be properly selected so as to comply with the purpose of a particular photosensitive material.

The invention is applicable to any color photosensitive materials having various layer arrangements. In the color photosensitive materials, the dry coating build-up of the entire layers is preferably up to 20.0 μ, more preferably up to 18.0 μ, provided that the support and the undercoat and backcoat layers thereon are excluded. The coating thickness is limited by taking into account the color developing agent which is taken into the respective layers of the color photosensitive material because the amount of residual color developing agent largely affects bleaching fog and occurrence of stains during picture storage after processing. Such bleaching fog and stain occurrence are caused by a larger increase of magenta color, attributable to green-sensitive layers, than those of cyan and yellow colors.

The coating thickness may be reduced insofar as the performance of the photosensitive material is not substantially impaired. In the color photosensitive materials, the lower limit of the dry coating thickness of the entire layers is typically 12.0 μ, provided that the support and the undercoat thereon are excluded. The total dry coating thickness of those layers (typically an anti-halation layer) provided between the photosensitive layer nearest to the support and the undercoat on the support has a lower limit oft 1.0 μ. The coating thickness of either the photosensitive layers or non-photosensitive layers can be reduced.

The layer thickness of a multi-layer color photosensitive material is measured as follows. A photosensitive material is stored for 7 days at 25° C. and RH 50% after its preparation. First of all, the total thickness of this photosensitive material is measured. Then the coating layers on the support are removed and the thickness is measured again, the difference representing the thickness of the entire coating layers of photosensitive material excluding the support. Thickness measurement may be done by means of a contact type piezoelectric transducer film thickness meter, model K.402B Standard by Anritsu Electric Co., Ltd. Removal of the coating layers from the support may be effected using an aqueous solution of sodium hypochlorite. Separately, a photograph is taken on a section of the photosensitive material using a scanning electron microscope (SEM) with a magnification of ×3000 or more. The total and individual thicknesses of the layers on the support are measured from the photo. Based on a comparison with the total coating thickness measured by the thickness meter (absolute value of actually measured thickness), the thickness of the individual layers is determined.

The percent swelling of the photosensitive material is preferably 50 to 200%, more preferably 70 to 150%, the percent swelling being defined as [(equilibrium swollen coating thickness in water at 25° C.— dry coating thickness at 25° C. and RH 55%)/dry coating thickness at 25° C. and RH 55%]×100. With a swelling outside this range, not only the amount of residual color developing agent increases, but also picture quality including photographic performance and desilvering ability and coating physical properties such as film strength are adversely affected.

Further, the photosensitive material preferably has a swelling speed $T_{\frac{1}{2}}$ of up to 15 seconds, more preferably up to 9 seconds, provided that the saturation swelling speed is 90% of the maximum swollen coating thickness achievable in processing with a color developer (38° C., 3,15") and the swelling speed $T_{\frac{1}{2}}$ is a time taken until one half of this coating thickness is reached.

The photographic emulsion layers of the color photo sensitive material used in the present invention contain a silver halide which is typically silver iodobromide, silver iodochloride or silver iodochlorobromide containing up to about 30 mol% of silver iodide. Especially preferred is silver iodobromide containing about 2 to 25 mol% of silver iodide.

The silver halide grains in the photographic emulsions may be grains having a regular crystal form such as cube, octahedron, and tetradecahedron, an irregular crystal form such as sphere and plate, a form having crystallographic defects such as twinning plane, or a composite form of these crystal forms. The silver halide grains may be either submicron grains of smaller than 0.2 microns or coarse grains as large as about 10 microns as measured in terms of a projected area diameter. The emulsions may be either mono-dispersed or multi-dispersed.

The photographic silver halide emulsions used in the practice of the present invention may be prepared by generally accepted methods as described in Research Disclosure (RD), No. 17643 (December 1978), pages 22–23, "I. Emulsion Preparation and Types" and RD No. 18716 (November 1979), page 648; P. Grafkides, "Chimie et Physique Photo. graphique", Paul Montel (1967); G.F. Duffin, "Photographic Emulsion Chemistry", The Focal Press (1966); and V.L, Zelikman et al., "Making and Coating Photographic Emulsion", The Focal Press (1964). Monodispersed emulsions are also useful as described in U.S. Pat. Nos. 3,574,628 and 3,655,394 and British Patent No. 1,413,748. Plate grains having an aspect ratio of at least about 5 may also be used. Plate grains are readily prepared by methods as described in Gutoff, "Photographic Science and Engineering", Vol. 14, 248-257 (1970), U.S. Pat. Nos. 4,434,226, 4,414,310, 4,430,048, and 4,439,520, and British Patent No. 2,112,157.

Grains may have a uniform structure, a core/shell structure in which core and shell have different halogen compositions, or a layered structure. Also included are grains having a silver halide of a different composition joined by epitaxial junction and grains having joined thereto a non-silver halide compound such as silver rhodanate and lead oxide. A mixture of different crystal form grains may also be used.

In general, the silver halide emulsions are physically ripened, chemically ripened, and spectrally sensitized before use. The additives used in these steps are described in Research Disclosure, Nos. 17643 and 18716. They are listed in the following table together with the pages to be referred to in the literature. Letters R and L mean right and left columns of the page.

| Additive | RD17643 | RD18716 |
|---|---|---|
| 1. Chemical sensitizer | 23 | 648R |
| 2. Sensitivity increasing agent | 23 | 648R |
| 3. Spectral sensitizer/ Supersensitizer | 23-24 | 648R-649R |
| 4. Brightener | 24 | |
| 5. Antifoggant/stabilizer | 24-25 | 649R |
| 6. Light absorber/filter dye/ UV absorber | 25-26 | 649R-650L |
| 7. Anti-staining agent | 25R | 650L-R |
| 8. Dye image stabilizing agent | 25 | |
| 9. Hardener | 26 | 651L |
| 10. Binder | 26 | 651L |
| 11. Plasticizer/lubricant | 27 | 650R |
| 12. Coating aid/surfactant | 26-27 | 650R |
| 13. Antistatic agent | 27 | 650R |

Various color couplers may be used. Examples of the coupler are described in the patents described in RD 17643, VII C-G.

Typical yellow couplers are described in the following patents.

| | | |
|---|---|---|
| JP-B 10739/1983 | | |
| U.S. Pat. Nos. | | |
| 3,933,501 | 3,973,968 | 4,022,620 |
| 4,248,961 | 4,314,023 | 4,326,024 |
| 4,401,752 | 4,511,649 | |
| British Patent Nos. 1,425,020 and 1,476,760 | | |
| European Patent No. 249,473A. | | |

Typical magenta couplers are 5-pyrazolone and pyrazoloazole couplers as described in the following patents and publications.

| | | |
|---|---|---|
| JP-A | | |
| 118034/1980 | 33552/1985 | 35730/1985 |
| 43659/1985 | 185951/1985 | 72238/1986 |
| U.S. Pat. Nos. | | |
| 3,061,432 | 3,725,064 | 4,310,619 |
| 4,351,897 | 4,500,630 | 4,540,654 |
| 4,556,630 | | |

-continued

| | | |
|---|---|---|
| European Patent No. 73,636 | | |
| WO (PCT) 88/04795 | | |
| RD Nos. 24220 (June 1984) and 24230 (June 1984). | | |

Typical cyan couplers are phenol and naphthol couplers as described in the following patents and publications.

| | | |
|---|---|---|
| JP-A 42658/1986, | | |
| U.S. Pat. Nos. | | |
| 2,369,929 | 2,772,162 | 2,801,171 |
| 2,895,826 | 3,446,622 | 3,758,308 |
| 3,772,002 | 4,052,212 | 4,146,396 |
| 4,228,233 | 4,254,212 | 4,296,199 |
| 4,296,200 | 4,327,173 | 4,333,999 |
| 4,334,011 | 4,451,559 | 4,427,767 |
| 4,690,889 | 4,753,871 | |
| West German Offenlegungsschrift No. 3,329,729 | | |
| European Patent Nos. 121,365A and 249,453A. | | |

Colored couplers for correcting unnecessary absorption of color developing dyes are typically those described in RD No. 17643, VII G, JP-B 39413/1982, U.S. Pat. Nos. 4,004,929, 4,138,258, and 4,163,670, and British Patent No. 1,146,368. Also useful are couplers which correct unnecessary absorption of color developing dyes by utilizing fluorescent dyes released upon coupling as described in U.S. Pat. No. 4,774,181, and couplers having as a coupling off group a dye precursor group capable of reacting with a developing agent to form a dye as described in U.S. Pat. No. 4,777,120.

Couplers providing color developing dyes having optimum diffusibility are preferably those described in U.S. Pat. No. 4,366,237, British Patent No. 2,125,570, European Patent No. 96,570, and West German Offenlegungsschrift No. 3,234,533. Typical examples of polymerized dye-forming couplers are described in U.S. Pat. Nos. 3,451,820, 4,080,211, 4,367,282, 4,409,320, and 4,576,910 and British Patent No. 2,102,173. Couplers which release photo. graphically useful residues upon coupling are also useful. Development inhibitor release (DIR) couplers are described in the patents cited in RD No. 17643, VII F, JP-A 151944/1982, 154234/1982, 184248/1985, and 37346/1988, U.S. Patent Nos. 4,248,962 and 4,782,012. Couplers which release nucleating agents or development promoters imagewise upon and 2,131,188 and JP-A 157638/1984 and 170840/1984.

Other couplers which can be used in the photosensitive material according to the invention include competitive couplers as described in U.S. Pat. No. 4,130,427; multi equivalent couplers as described in U.S. Pat. No. 4,283,472, 4,310,618 and 4,338,393; DIR redox compound release couplers, DIR coupler release couplers, DIR coupler release redox compounds or DIR redox release redox compounds as described in JP-A 185950/1985 and 24252/1987; couplers which release dyes which restore their color after coupling off as described in European Patent No. 173,302A; bleaching promoter release couplers as described in RD Nos. 11449 and 24241 and JP-A 201247/1986; ligand release couplers as described in U.S. Pat. No. 4,553,477; leuco dye release couplers as described in JP-A 75747/1988; and fluorescent dye release couplers as described in U.S. Pat. No. 4,774,181.

The couplers may be introduced into photosensitive materials by any well-known dispersion methods. One such method is dispersion of oil droplets in water using high boiling organic solvents as described in U.S. Pat. No. 2,322,027. Examples of high-boiling organic solvents having a boiling point of higher than about 175° C. under atmospheric pressure include phthalates such as dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1.diethylpropyl) phthalate; phosphates and phosphonates such as triphenyl phosphate, tricresyl phosphate, 2-ethylhexyldiphenyl phosphate, tricyclohexyl phosphate, tri 2 ethylhexyl phosphate, tridodecyl phosphate, tributoxyethyl phosphate, trichloropropyl phosphate, and di-2-ethylhexylphenyl phosphonate; benzoates such as 2-ethylhexyl benzoate, dodecyl benzoate, and 2-ethylhexyl p-hydroxybenzoate; amides such as N,N-diethyldodecaneamide, N,N-diethyllaurylamide, and N-tetradecylpyrrolidone; alcohols and phenols such as isostearyl alcohol and 2,4-di t-amylphenol; aliphatic carboxylates such as bis(2-ethylhexyl) sebacate, dioctyl azelate, glycerol tributyrate, isostearyl lactate, and trioctyl citrate; anilines such as N,N-dibutyl.2-butoxy-5-t-octyl aniline; and hydrocarbons such as paraffin, dodecyl benzene, and isopropylnaphthalene. Auxiliary solvents are organic solvents having a boiling point of higher than about 30° C., preferably from 50° C. to 160° C., typical examples of which include ethyl acetate, butyl acetate, ethyl propionate, methyl ethyl ketone, cyclohexanone, 2 ethoxy. ethylacetate, and dimethylformamide.

Another useful method is latex dispersion, steps, benefits and impregnating latex of which are described in U.S. Pat. No. 4,199,363, West German OLS 2,541,274 and 2,541,230. It is also possible to disperse and emulsify the coupler in an aqueous solution of hydrophilic colloid by impregnating a loadable latex polymer (see U.S. Pat. No. 4,203,716) with the coupler in the presence or absence of a high-boiling organic solvent or by dissolving the coupler in a water-insoluble, organic solvent-soluble polymer. Useful are homopolymers and copolymers as described in WO 88/00723, pages 12–30. Use of acrylamide polymers is recommended for color image stability.

The invention is applicable to a variety of color photosensitive materials and especially adapted for general and motion picture color negative films and slide and television color reversal films.

Suitable supports which can be used herein are described in RD No. 17643, page 28 and No. 18716, pages 647–648.

EXAMPLE

Examples of the present invention are given below by way of illustration and not by way of limitation.

Example 1

A multilayer color photosensitive material was prepared by coating the layers formulated below on an undercoated cellulose triacetate film support.

Composition of photosensitive layers

In the following formulation, the coating weight is reported in gram/m$^2$ for the coupler, additives and gelatin, in gram/m$^2$ of silver for the silver halide and colloid silver, and in mol per mol of silver halide in the same layer for the sensitizing dye.

| Layer | Ingredient | Coating weight |
|---|---|---|
| | 1st layer: Anti-halation layer, 1.2μ thick | |
| | black colloid silver | 0.18 Ag |
| | gelatin | 1.50 |
| | 2nd layer: Intermediate layer, 1.7μ thick | |
| | 2,5-di-t-pentadecylhydroquinone | 0.18 |
| | EX-1 | 0.07 |
| | EX-3 | 0.02 |
| | EX-12 | 0.002 |
| | U-1 | 0.06 |
| | U-2 | 0.08 |
| | U-3 | 0.10 |
| | HBS-1 | 0.10 |
| | HBS-2 | 0.02 |
| | gelatin | 1.40 |
| | 3rd layer: First red-sensitive emulsion layer, 1.5μ thick | |
| | Emulsion A | 0.25 Ag |
| | Emulsion B | 0.25 Ag |
| | Sensitizing dye I | $6.9 \times 10^{-5}$ |
| | Sensitizing dye II | $1.8 \times 10^{-5}$ |
| | Sensitizing dye III | $3.1 \times 10^{-4}$ |
| | EX-2 | 0.335 |
| | EX-10 | 0.020 |
| | HBS-1 | 0.060 |
| | gelatin | 1.20 |
| | 4th layer: Second red-sensitive emulsion layer, 2.0μ thick | |
| | Emulsion G | 1.0 Ag |
| | Sensitizing dye I | $5.1 \times 10^{-5}$ |
| | Sensitizing dye II | $1.4 \times 10^{-5}$ |
| | Sensitizing dye III | $2.3 \times 10^{-4}$ |
| | EX-2 | 0.400 |
| | EX-3 | 0.050 |
| | EX-10 | 0.015 |
| | HBS-1 | 0.060 |
| | gelatin | 1.55 |
| | 5th layer: Third red-sensitive emulsion layer, 2.4μ thick | |
| | Emulsion D | 1.60 Ag |
| | Sensitizing dye I | $5.4 \times 10^{-5}$ |
| | Sensitizing dye II | $1.4 \times 10^{-5}$ |
| | Sensitizing dye III | $2.4 \times 10^{-4}$ |
| | EX-3 | 0.010 |
| | EX-4 | 0.080 |
| | EX-2 | 0.097 |
| | HBS-1 | 0.22 |
| | HBS-2 | 0.10 |
| | gelatin | 1.85 |
| | 6th layer: Intermediate layer, 1.0μ thick | |
| | EX-5 | 0.040 |
| | HBS-1 | 0.020 |
| | gelatin | 1.15 |
| | 7th layer: First green-sensitive emulsion layer, 1.5μ thick | |
| | Emulsion A | 0.15 Ag |
| | Emulsion B | 0.15 Ag |
| | Sensitizing dye V | $3.0 \times 10^{-5}$ |
| | Sensitizing dye VI | $1.0 \times 10^{-4}$ |
| | Sensitizing dye VII | $3.8 \times 10^{-4}$ |
| | EX-6 | 0.100 |
| | EX-14 | 0.250 |
| | EX-1 | 0.021 |
| | EX-7 | 0.030 |
| | EX-8 | 0.025 |
| | HBS-1 | 0.300 |
| | HBS-3 | 0.010 |
| | gelatin | 0.90 |
| | 8th layer: Second green-sensitive emulsion layer, 1.0μ thick | |
| | Emulsion C | 0.45 Ag |
| | Sensitizing dye V | $2.1 \times 10^{-5}$ |
| | Sensitizing dye VI | $7.0 \times 10^{-5}$ |
| | Sensitizing dye VII | $2.6 \times 10^{-4}$ |
| | EX-6 | 0.060 |
| | EX-14 | 0.053 |
| | EX-8 | 0.018 |
| | EX-7 | 0.026 |
| | HBS-1 | 0.160 |
| | HBS-3 | 0.008 |
| | gelatin | 0.70 |
| | 9th layer: Third green-sensitive emulsion layer, 2.2μ thick | |
| | Emulsion E | 1.2 Ag |

-continued

| Layer | Ingredient | Coating weight |
|---|---|---|
| | Sensitizing dye V | $3.5 \times 10^{-5}$ |
| | Sensitizing dye VI | $8.0 \times 10^{-5}$ |
| | Sensitizing dye VII | $3.0 \times 10^{-4}$ |
| | EX-13 | 0.015 |
| | EX-11 | 0.100 |
| | EX-1 | 0.025 |
| | HBS-1 | 0.25 |
| | HBS-2 | 0.10 |
| | gelatin | 1.75 |
| | 10th layer: Yellow filter layer, 1.0μ thick | |
| | yellow colloid silver | 0.05 Ag |
| | EX-5 | 0.08 |
| | HBS-1 | 0.03 |
| | gelatin | 1.10 |
| | 11th layer: First blue-sensitive emulsion layer, 2.0μ thick | |
| | Emulsion A | 0.08 Ag |
| | Emulsion B | 0.07 Ag |
| | Emulsion F | 0.07 Ag |
| | Sensitizing dye VIII | $3.5 \times 10^{-4}$ |
| | EX-9 | 0.721 |
| | EX-8 | 0.042 |
| | HBS-1 | 0.28 |
| | gelatin | 1.25 |
| | 12th layer: Second blue-sensitive emulsion layer, 1.1μ thick | |
| | Emulsion G | 0.45 Ag |

-continued

| Layer | Ingredient | Coating weight |
|---|---|---|
| | Sensitizing dye VIII | $2.1 \times 10^{-4}$ |
| | EX-9 | 0.154 |
| | EX-10 | 0.007 |
| | HBS-1 | 0.05 |
| | gelatin | 0.95 |
| | 13th layer: Third blue-sensitive emulsion layer, 1.2μ thick | |
| | Emulsion H | 0.77 Ag |
| | Sensitizing dye VIII | $2.2 \times 10^{-4}$ |
| | EX-9 | 0.20 |
| | HBS-1 | 0.07 |
| | gelatin | 0.90 |
| | 14th layer: First protective layer, 1.5μ thick | |
| | Emulsion I | 0.5 Ag |
| | U-4 | 0.11 |
| | U-5 | 0.17 |
| | HBS-1 | 0.05 |
| | gelatin | 1.30 |
| | 15th layer: Second protective layer, 2.0μ thick | |
| | Polymethyl acrylate particles (diameter ~1.5μ) | 0.54 |
| | S-1 | 0.20 |
| | gelatin | 1.25 |

In addition to the foregoing ingredients, gelatin hardener H-1 and surface-active agent were added to each layer.

Emulsion Grain Parameters

| Emulsion | Average AgI content | Grain size Average | Grain size Coef. of var. | Diameter/ thickness | Ag ratio (AgI content %) |
|---|---|---|---|---|---|
| A | 4.1% | 0.45 μm | 27% | 1 | Core/shell = ⅓ (13/1) double structure grains |
| B | 8.9% | 0.70 μm | 14% | 1 | Core/shell = 3/7 (25/2) double structure grains |
| C | 10% | 0.75 μm | 30% | 2 | Core/shell = ½ (24/3) double structure grains |
| D | 16% | 1.05 μm | 35% | 2 | Core/shell = ½ (40/0) double structure grains |
| E | 10% | 1.05 μm | 35% | 3 | Core/shell = ½ (24/3) double structure grains |
| F | 4.1% | 0.25 μm | 28% | 1 | Core/shell = ⅓ (13/1) double structure grains |
| G | 13.6% | 0.75 μm | 25% | 2 | Core/shell = ½ (40/0) double structure grains |
| H | 14% | 1.30 μm | 25% | 3 | Core/shell = 37/63 (34/3) double structure grains |
| I | 1% | 0.07 μm | 15% | 1 | Uniform grains |

EX-1

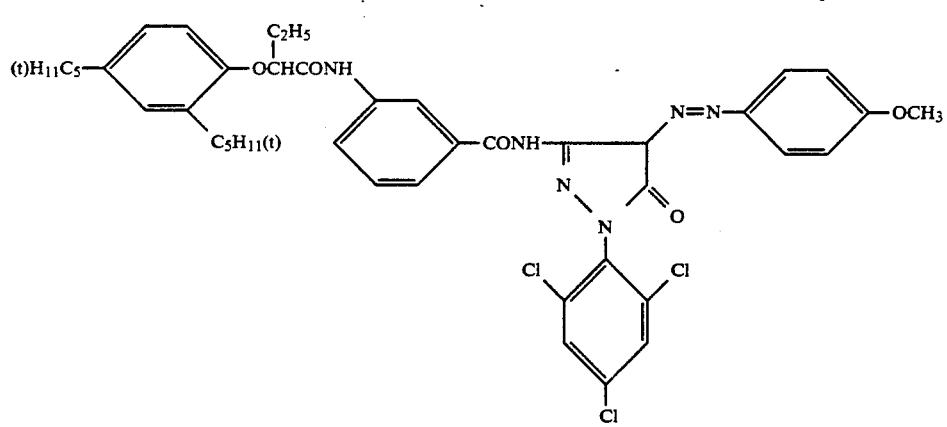

EX-2

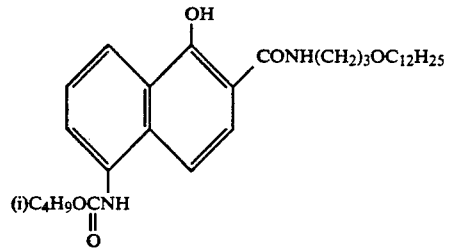

-continued
EX-3
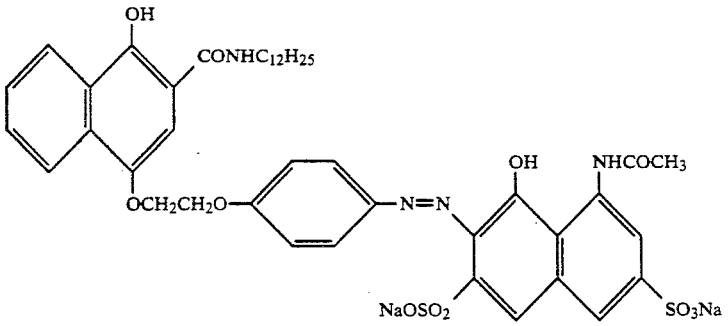
EX-4
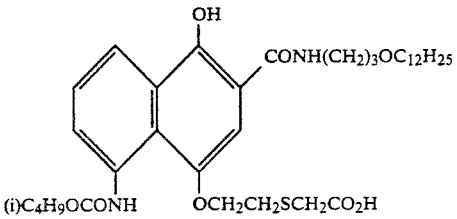
EX-5
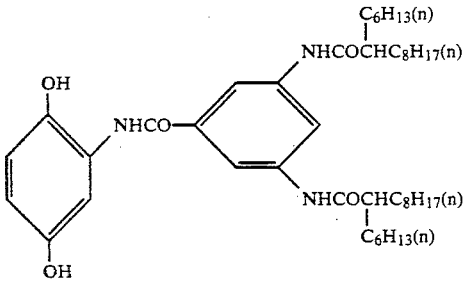
EX-6
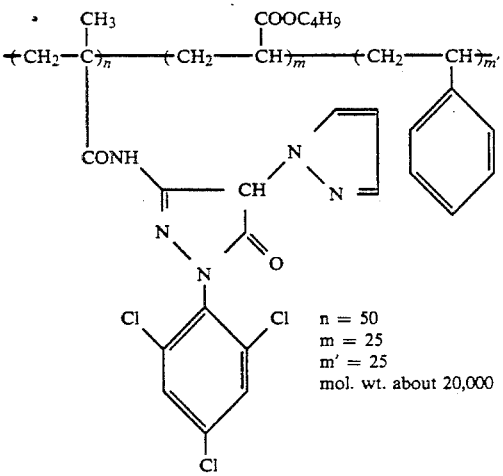

-continued
EX-7
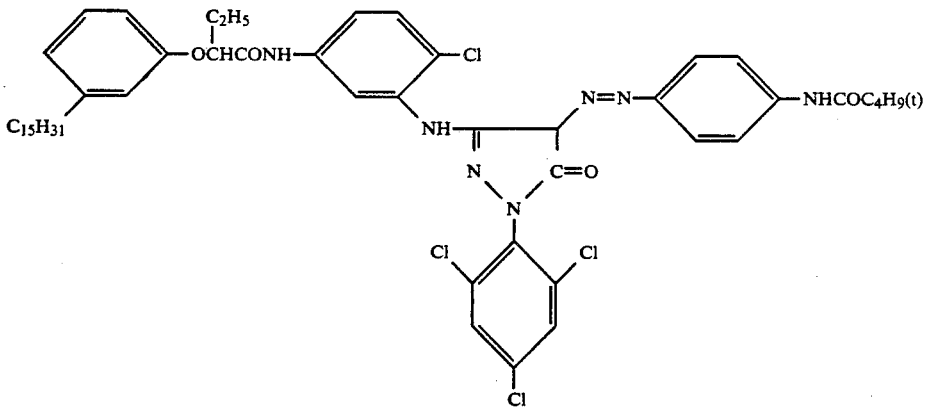
EX-8
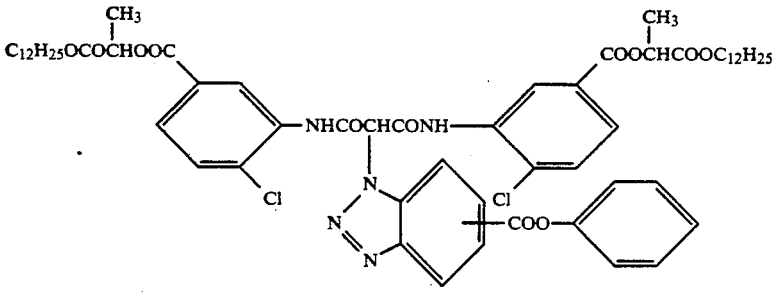
EX-9
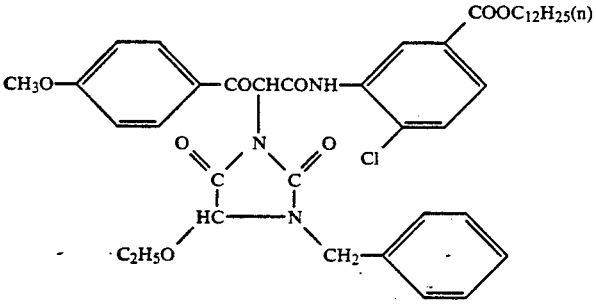
EX-10
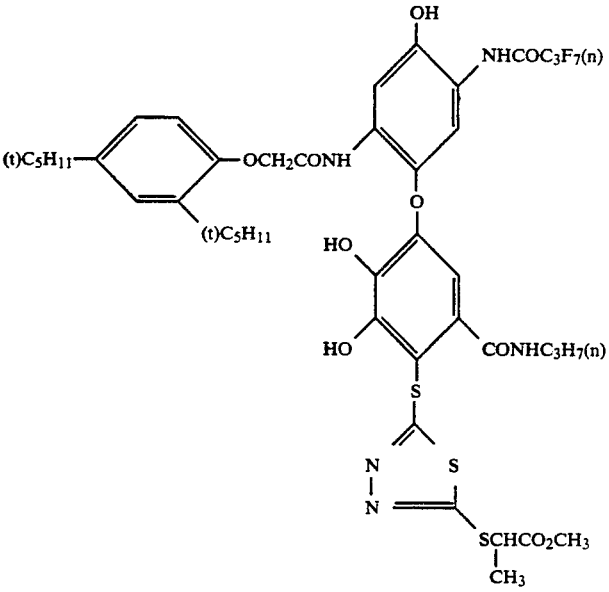

-continued
EX-11
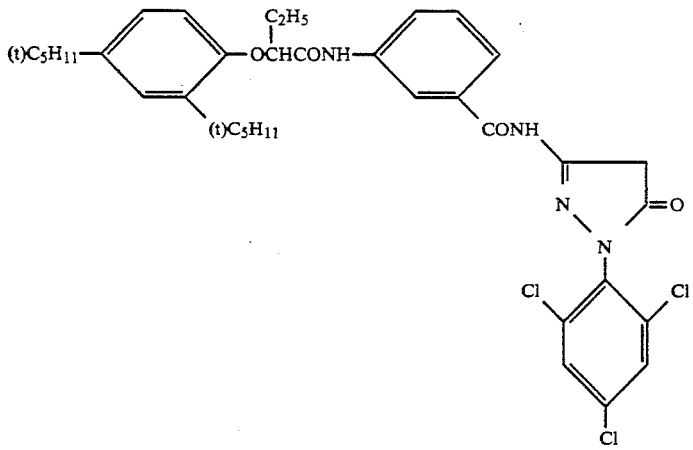
EX-12
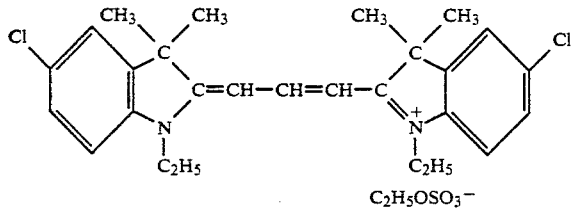
EX-13
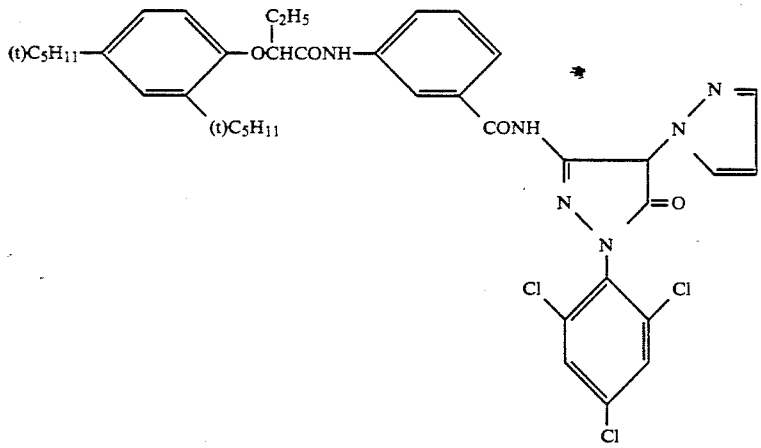
EX-14
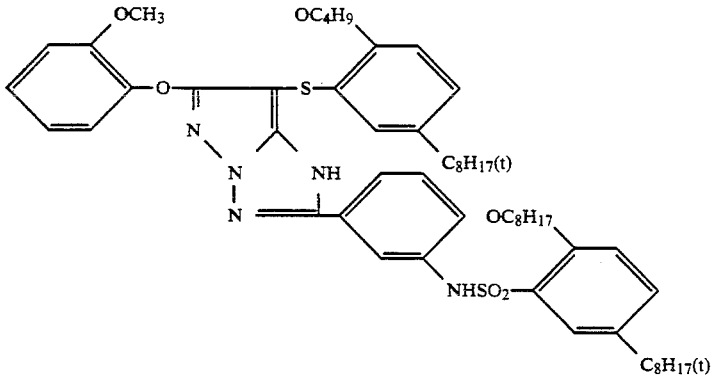

-continued
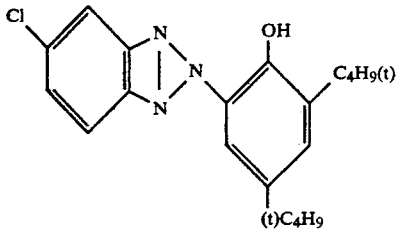
U-1
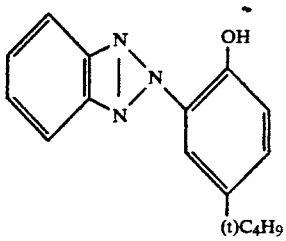
U-2
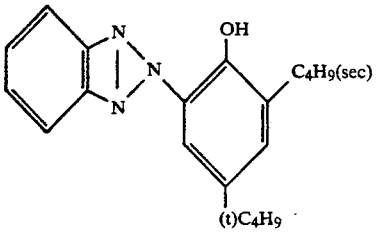
U-3
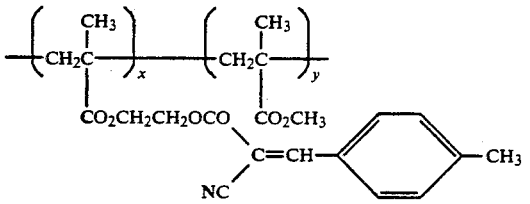
x:y = 70:30 (wt %)
U-4
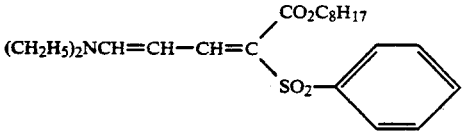
U-5
Tricresyl phosphate — HBS-1
Di-n-butyl phthalate — HBS-2
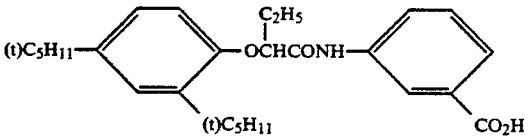
HBS-3
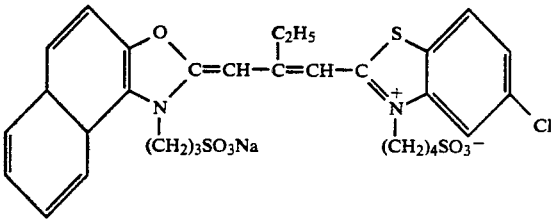
Sensitizing Dye I -continued
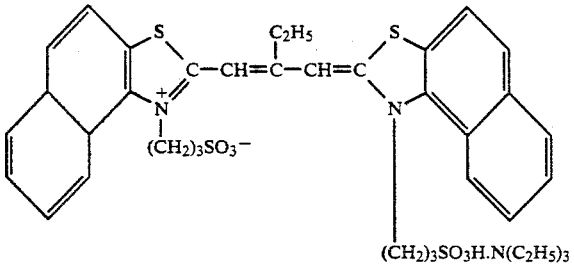
Sensitizing Dye II
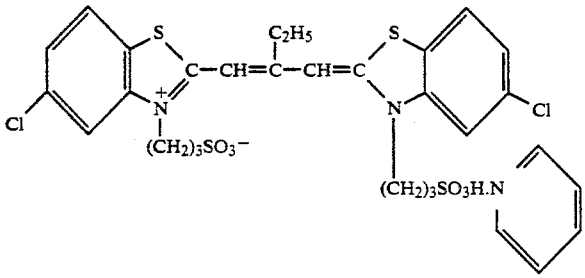
Sensitizing Dye III
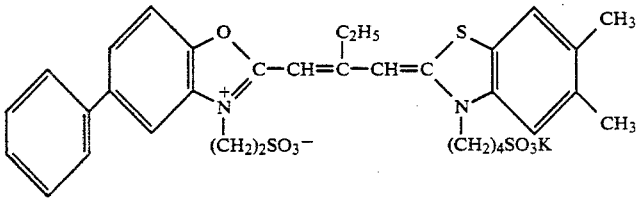
Sensitizing Dye V
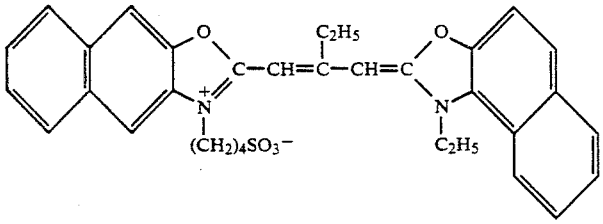
Sensitizing Dye VI
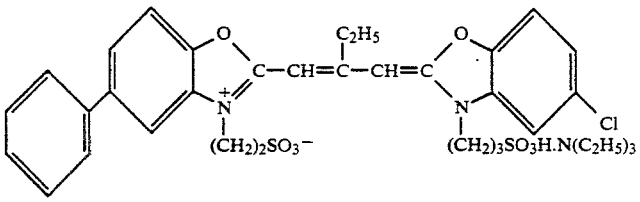
Sensitizing Dye VII
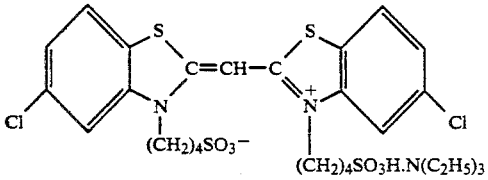
Sensitizing Dye VIII
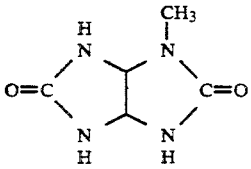
S-1

-continued

H-1

$$CH_2{=}CH{-}SO_2{-}CH_2{-}CONH{-}CH_2$$
$$\quad\quad\quad starter A smelled. Procedures B and C using sodium hydroxide and potassium hydroxide were low in desilvering ability. Bleaching starters B and C had no smell problem, but was strongly alkaline to cause a safety problem. As did the ammonia, they tended to vary their concentration by absorbing carbon dioxide from air. This partly caused poor desilvering ability. It was also found that precipitates of iron hydroxide often settled when a ferric aminopolycarboxylic acid complex was used as the bleaching agent.

In contrast, Procedures D to I experienced none of the problems occurring in Procedures A to C.

Example 2

Color paper, Fuji Color Super HG (width 117 mm) manufactured by Fuji Photo Film Co., Ltd. was exposed imagewise, and then continuously processed (running test) through an automatic processor, Fuji Color Paper Processor Model PP600 according to the following procedure until the color developer was replenished twice the volume of the color developer tank.

| Step | Temp. | Time | Replenishment* | Tank volume |
|---|---|---|---|---|
| Color development | 38° C. | 1'40" | 290 ml | 17 l |
| Bleach-fixing | 38° C. | 60" | — | 9 l |
| Washing (1) | 30–34° C. | 20" | — | 4 l |
| Washing (2) | 30–34° C. | 20" | — | 4 l |
| Washing (3) | 30–34° C. | 20" | 364 ml | 4 l |
| Drying | 70–80° C. | 50" | | |

*per square meter of photosensitive material

Water washing was a counterflow washing from tank (3) to (2) to (1).

The processing solutions had the following compositions.

| Color developer | Starting solution | Replenisher |
|---|---|---|
| Water | 800 ml | 800 ml |
| Diethylenetriamine pentaacetate | 1.0 g | 1.0 g |
| Nitrilotriacetic acid | 2.0 g | 2.0 g |
| 1-hydroxyethylidene-1,1-diphosphonic acid | 2.0 g | 2.0 g |
| Benzyl alcohol | 16 ml | 22 ml |
| Diethylene glycol | 10 ml | 10 ml |
| Sodium sulfite | 2.0 g | 2.5 g |
| Potassium bromide | 0.5 g | — |
| Potassium carbonate | 30 g | 30 g |
| N-ethyl-N-(β-methanesulfonamidoethyl)-3-methyl-4-aminoaniline hydrogen sulfate | 5.5 g | 7.5 g |
| Hydroxylamine hydrogen sulfate | 2.0 g | 2.5 g |
| Brightener* | 1.5 g | 2.0 g |
| Water totaling to | 1000 ml | 1000 ml |
| pH | 10.20 | 10.60 |

| Bleach-fixing solution | Replenisher |
|---|---|
| Water | 400 ml |
| Ammonium thiosulfate (70%) | 300 ml |
| Sodium sulfite | 10 g |
| Ammonium iron (III) EDTA | 120 g |
| Disodium EDTA | 10 g |
| Water totaling to | 1000 ml |
| pH (25° C.) | 6.30 |

*WHITEX 4B manufactured by Sumitomo Chemical K.K.

Wash water

Wash water was common to the starting solution and the replenisher and the same as in Example 1.

In the continuous process, starting bleach-fixing solutions were prepared by adding 42 ml of the bleaching starters described in Example 1 to 750 ml of the bleach-fixing solution and diluting with water to a total volume of 1 liter. The results were approximately the same as in Example 1.

As described above, the bleaching starter of the invention permits quick processing in a step using a solution having a bleaching function, especially a bleaching step immediately following a color development step. Irrespective of quick processing, sufficient desilvering is achieved. The bleaching starter has no handling problem regarding smell and safety.

Although some preferred embodiments have been described, many modifications and variations may be made thereto in the light of the above teachings. It is therefore to be understood that within the scope of the appended claims, the invention may be practiced otherwise than as specifically described.

We claim:

1. In a method for processing a color photographic silver halide photosensitive material after imagewise exposure, comprising the steps of: color development and processing with a solution having a bleaching function, the improvement wherein said solution having a bleaching function is prepared by adding a starter to a solution containing a bleaching agent, said starter comprising at least one member selected from compounds of general Formula (II) in water in an amount of from 3 to 10 mol/liter:

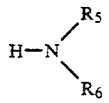

(II)

wherein $R_5$ is a hydrosyalkyl radical having up to 6 carbon atoms, and $R_6$ is selected from the group consisting of a hydrogen atom, an alkyl radical having up to 6 carbon atoms, and a hydroxyalkyl radical having up to 6 carbon atoms.

2. The method of claim 1 wherein said starter is at pH 6 to 13.

3. The method of claim 1 wherein said bleaching agent is an iron aminopolycarboxylic acid complex.

4. The method of claim 3 wherein said solution having a bleaching function is a bleaching solution at pH 2.5 to 6.5.

5. The method of claim 3 wherein said iron aminoplycarboxylic acid complex has a redox potential of at least 150 mV.

6. The method of claim 4 wherein said bleaching solution further contains at least 1.2 mol/liter of an acid having a pKa of 2.0 to 5.0.

7. The method of claim 3 wherein said solution having a bleaching function is a bleach-fixing solution at pH 5 to 9.

8. The method of claim 1 wherein said starter is added to said solution containing a bleaching agent in a volume ratio of 2/1 to 1/200.

9. The method of claim 1 wherein said solution having a bleaching function is replenished as the color photographic silver halide photosensitive material is processed.

10. A method for preparing a processing solution having a bleaching function for a color photographic silver halide photosensitive material, comprising the step of adding a starter to a replenisher solution containing a bleaching agent, said starter comprising at least one member selected from compounds of general formula (II) in water in an amount of from 3 to 10 mol/liter:

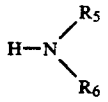

(II)

wherein $R_5$ is a hydroxyalkyl radical having up to 6 carbon atoms, and $R_6$ is selected from the group consisting of a hydrogen atom, an alkyl radical having up to 6 carbon atoms, and a hydroxyalkyl radical having up to 6 carbon atoms.

11. The method of claim 7 or 8 wherein said starter is added to said replenisher solution in a volume ratio of 2/1 to 1/200.

12. The method of claim 10 wherein said replenisher is a bleaching replenisher.

13. The method of claim 10 wherein said replenisher is a bleach-fixing replenisher.

* * * * *

UNITED STATES PATENT AND TRADEMARK OFFICE

CERTIFICATE OF CORRECTION

PATENT NO. : 5,070,004

DATED : December 3, 1991

INVENTOR(S) : Yoshihiro FUJITA et al

It is certified that error appears in the above-identified patent and that said Letters Patent is hereby corrected as shown below:

Claim 1, at column 38, line 36, delete "hydrosyalkyl" and insert --hydroxyalkyl--.

Claim 5, at column 38, line 51, delete "plycarboxylic" and insert --polycarboxylic--.

Signed and Sealed this

Thirteenth Day of April, 1993

*Attest:*

STEPHEN G. KUNIN

*Attesting Officer*

*Acting Commissioner of Patents and Trademarks*